United States Patent [19]

Frost et al.

[11] Patent Number: 4,926,603

[45] Date of Patent: May 22, 1990

[54] CENTERLESS GRINDING

[75] Inventors: Martin Frost, Bristol; Bruce J. Horton, Hertfordshire; Jonathan L. Tidd, Devon, all of England

[73] Assignee: University of Bristol, United Kingdom

[21] Appl. No.: 214,668

[22] Filed: Jul. 1, 1988

[30] Foreign Application Priority Data

Jul. 2, 1987 [GB] United Kingdom ..... 8715544

[51] Int. Cl.[5] ..... B24B 49/00

[52] U.S. Cl. ..... 51/165.77; 51/165.71

[58] Field of Search ..... 51/165 R, 103 R, 80 R, 51/80 A, 95 R, 165.71, 165.77, 238 S, 238 GG, 103 WH, 103 TF

[56] References Cited

U.S. PATENT DOCUMENTS 4,055,027 10/1977 Freddi ..... 51/103 WH

*Primary Examiner*—Judy Hartman
*Assistant Examiner*—Maurina Rachuba
*Attorney, Agent, or Firm*—Arnold S. Weintraub; Gerald R. Black

[57] ABSTRACT

There is disclosed a grinding machine in which a component of circular cross-section is capable of being ground, the component being supported at points on its periphery during grinding, said machine including (i) an analysing means whereby periodic irregularities in the periphery of the component as it is being ground may be detected and analyzed to determine the periodic adjustment in the position of the component necessary to eliminate, during grinding, the detected periodic irregularities, said analyzing means including means for producing a signal indicative of the adjustment necessary and (ii) means for periodically adjusting the position of the component in response to the signals from the analyzing means thereby to cause said periodic irregularities to be eliminated.

8 Claims, 3 Drawing Sheets

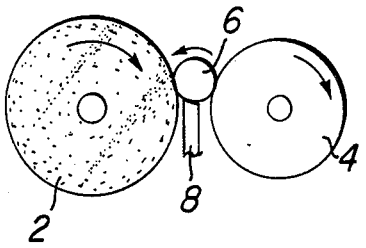
Fig-1
Fig-2
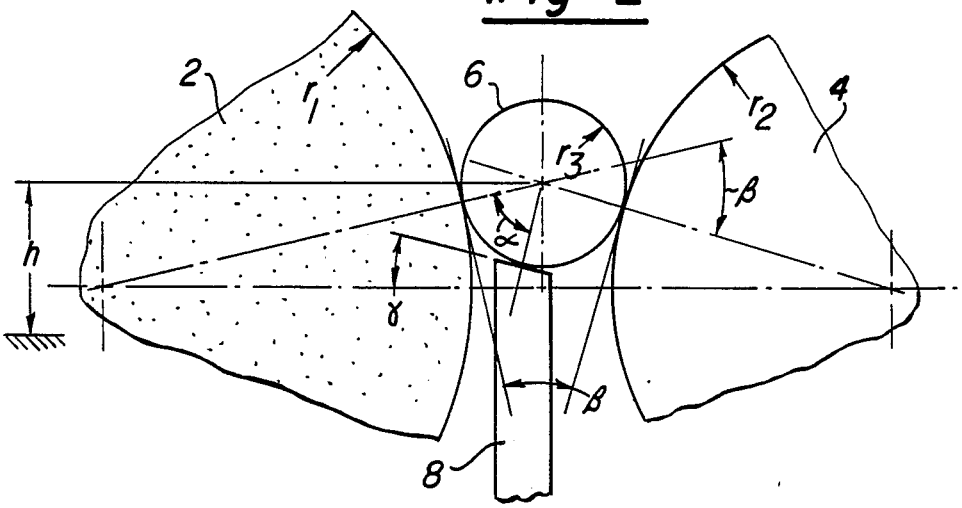
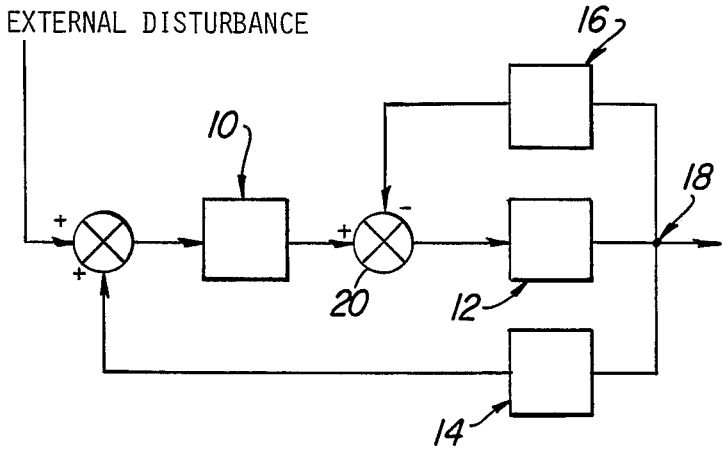
Fig-4

CENTERLESS GRINDING

This invention relates to a device for controlling lobing in plunge centreless grinding.

Centreless grinding is widely used for the finishing of precision cylindrical components. The degree of roundness which can be achieved, however, depends on how accurately the axis of rotation can be maintained. The position of this axis is defined by the intersection of normals to the point of contact of the component profile with two external constraints which are the regulating wheel and workplate respectively.

If the profile is at any time non-circular then the points of contact, and consequently the instantaneous centre of rotation, will change. This in turn brings about a change in the grinding conditions such that new irregularities occur in the profile. Thus, a feedback situation is created which can result in the generation of lobes of a particular frequency around the profile which grow in amplitude with time. The centreless grinding process is intrinsically unstable and this is detrimental to the quality of the component produced.

A truly circular component can only be produced if the position of the instantaneous centre of rotation remains stationary during grinding. However, it is difficult to determine the centre of rotation when the outer profile is constantly changing. Some indication of the amplitude of motion may be deduced from the amplitude of lobing at any instant, but conversely this is difficult to measure in-process because there is no fixed reference point in space. Consequently, without periodically removing the component during grinding there is no direct method for determining the amount of correction necessary to achieve a fixed rotational axis.

During grinding a force is generated by the action of the grinding wheel or the part being ground, and a component of this force will be reacted by the workplate. Additionally the workplate may sense other force variations which are due to the inertial movement of the part, hydrodynamic forces executed by the coolant, or by traction forces imposed by the regulating wheel. If the amplitude of lobing is growing with time then it is reasonable to suppose that the depth of cut in the grinding zone will be varying. The variation of grinding force will thus be periodically related to the lobing frequency which is defined in real time by the poduct of the number of lobes and the rotational frequency of the part. Other periodic force variations of the same frequency may also be expected from the additional sources described above.

Consequently the workplate will sense variations in force which are at the lobe frequency and which are in some way related to the amplitude and rate of growth of lobing, and these periodic force variations may then be used to determine the necessary control which needs to be exerted on the positioning of the instantaneous centre of rotation during grinding.

The present invention provides a means by which periodic force variations on the component support may be determined and enables such measured forced variations to be analysed in order to determine appropriate control strategiums. By the present invention, the appropriate control signals may be transmitted to the component support in such a way that a physical movement of the component occurs to counteract the motion of the instantaneous centre of rotation. Finally, by the present invention, the effect of the control signal can be continuously monitored to change adaptively the gain and phase in a feedfoward loop such that the lobes are eliminated at the maximum rate while the control process is at all times stable.

According to the present invention there is provided a grinding machine in which a component of circular cross-section is capable of being ground, the component being supported at points on its periphery during grinding, said machine including (i) an analysing means whereby periodic irregularities in the periphery of the component as it is being ground may be detected and analysed to determine the periodic adjustment in the position of the component necessary to eliminate, during grinding, the detected periodic irregularities, said analysing means including means for producing a signal indicative of the adjustment necessary and (ii) means for periodically adjusting the position of the component in response to the signals from the analysing means thereby to cause said periodic irregularities to be eliminated Preferably, the analysing means determines the periodic irregularities in the periphery of the component from parameters sensed from the machine. For instance, the sensed parameters may be the reaction forces exerted on its support by the component during grinding. The machine may therefore include sensors to detect such forces and actuators which respond to components of the sensed forces which are fed forward with variable phase and amplification.

Preferably, the machine comprises:

a grinding wheel and a regulating wheel, the respective axes of which are generally parallel, the grinding wheel and the regulating wheel being aligned and spaced apart to define therebetween a zone in which a component to be ground is capable of being accommodated, the circumference of each of the grinding wheel and the regulating wheel providing a point of contact with the component to be ground;

a support element disposed between the grinding and regulating wheels to provide a third point of contact with the component to be ground;

means for sensing, in use, the periodic force being exerted on the support element by the component said periodic force being indicative of the lobe frequency on the periphery of a component being ground;

analysing and computing means for analysing the periodic force exerted on the support element by the component, computing the periodic adjustment in height of the support necessary to eliminate the lobes on the periphery of the component and producing a signal indicative of the necessary adjustment in height of the support required; and means for adjusting the height of the support in response to the signal from the analysing and computing means.

According to another aspect of this invention there is provided a method of grinding a circular cross-section component in a grinding machine, which method comprises:

(i) supporting the component at points on its periphery and causing the component to rotate against a grinding surface;

(ii) detecting periodic irregularities in the periphery of the component and analysing those periodic irregularities to determine the adjustment in the position of the component necessary to eliminate said irregularities; and (iii) adjusting the position of the component by the amount determined necessary in step (ii) thereby to eliminate the irregularities.

Preferably, this method comprises the steps of:

(a) sensing periodic force components on the support and filtering unwanted signals, for example by analysis;

(b) determination of an initial phase and gain to apply to this signal before feeding forward, (c) closure of the feedforward loop so that the signal can be applied to an actuator in the support, thereby preferably reducing the amplitude of the measured force signal; and (d) adaptive monitoring of the rate of change of the measured force signal so that phase and gain in the feedforward loop can be finely adjusted to ensure optimum roundness of the component.

For a better understanding of the present invention, and to show how it may be carried into effect, reference will now be made by way of example to the accompanying drawings, in which:

FIG. 1 is a diagram which defines the geometry of centreless grinding,

FIG. 2 is an enlarged view of a portion of FIG. 1;

FIG. 4 is a schematic diagram showing the main elements of the feedback and proposed feed forward loops in centreless grinding;

Figure 3:
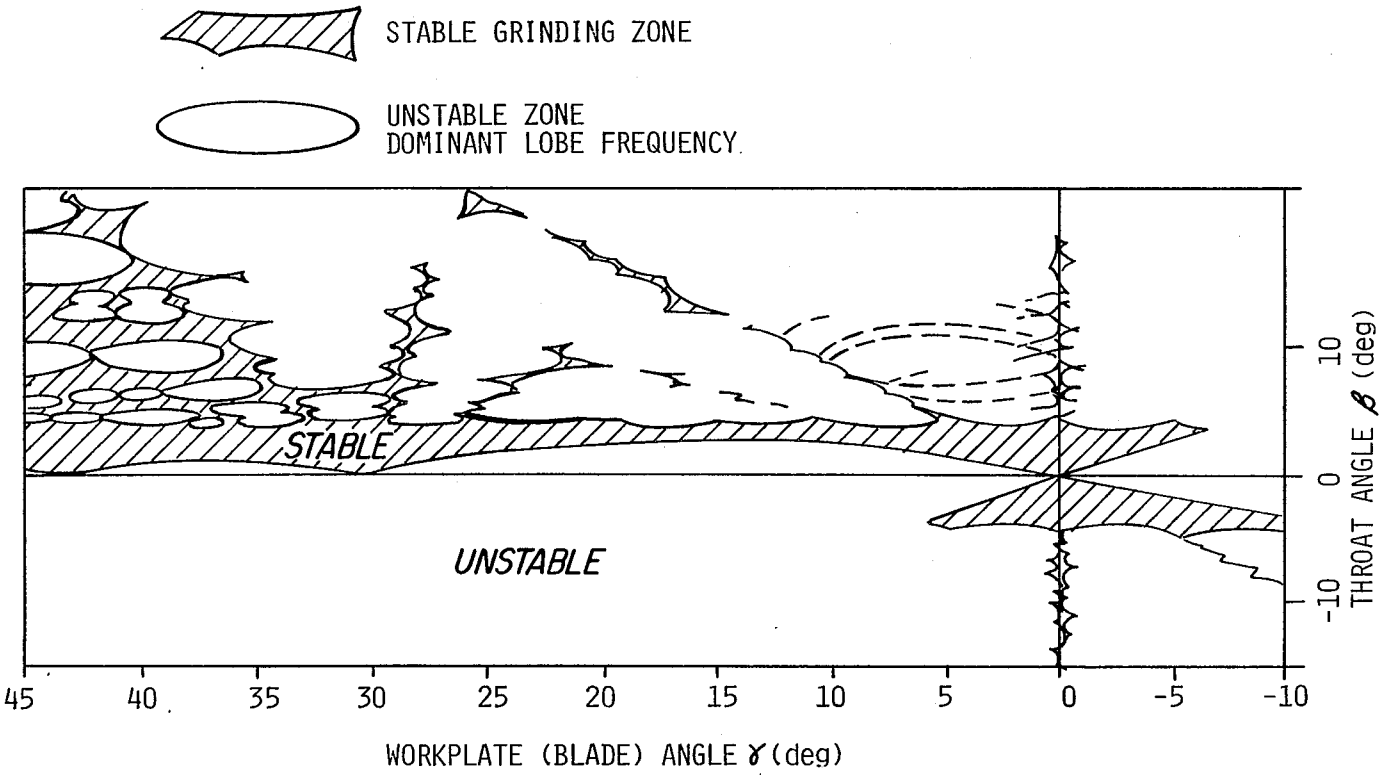
FIG. 3 is a map showing the relationship between unstable integer lobe frequencies and the centreless grinding geometry.

According to FIGS. 1 and 2, the geometry of centreless grinding is defined by the relative positions of a grinding wheel 2, regulating wheel 4, work component 6 and workplate 8. The position of each of these elements is defined by $r_1$, $r_2$ and $r_3$, being the radii of the grinding wheel, regulating wheel and component respectively, the angle of the support blade $\gamma$ and the angles $\alpha$ and $\beta$ which are in turn controlled by the parameter h, being the vertical position of the instantaneous centre of rotation of component 4. It can be seen that for fixed values of parameters $r_1$, $r_2$, $r_3$ and $\gamma$, the parameters $\alpha$ and $\beta$ can be controlled by variation of parameter h.

According to FIG. 3, the geometry of the centreless grinding process, as defined by the workplate angle $\gamma$ and throat angle $\beta$, will determine the unstable integer lobe frequency that will be generated. If it is assumed that the wavelength has a lower limit, due to mechanical filtering at the regulating wheel and workplate contacts, and which varies with component diameter, then it can be seen that the process is generally unstable within the regions shown.

According to FIG. 4 the unstable feedback loop which is characteristic of the centreless grinding process comprises a transfer function 10 which represents the propagation delay for a profile irregularity, a transfer function 12 which represents the rate of increase of the lobe amplitude and a transfer function 14 which represents the elastic characteristics of the machine structure which is reacting the grinding forces. Thus, it can be seen that for a positive value of growth rate in element 12, an increased amplitude is experienced by element 10 in accordance with the machine stiffness defined by element 14. The feed forward loop contains a transfer function 16 which represents an amplification and phase shift of the signal appearing at 18. The resultant signal is fed forward to summing junction 20, then preferably effecting a cancellation of the original error signal arising from element 8 thus preventing feedback through element 14 and consequent lobe growth.

Figure 5:
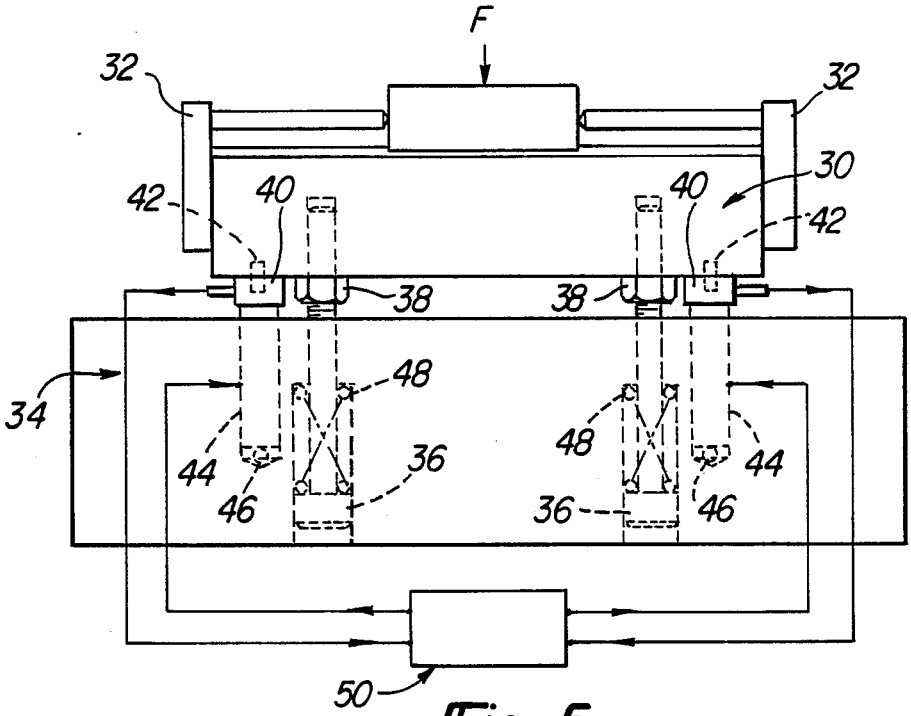
FIG. 5 is a diagram of a grinding machine in accordance with the present invention, the grinding and regulating wheels having been removed.

According to FIG. 5 a control system which embodies the invention may comprise a workplate 30, incorporating end-stops 32 to prevent axial movement of the component, the workplate 30 being connected to a beam 34 by fitted screws 36 which are locked to element 30 with lock nuts 38. A piezoelectric force transducer 40 is interposed between workplate 30 by a locating pin 42 and a piezoelectric actuator 44 which is contained in beam 34 and supported on a ball 46. A spring 48, co-axial with element 36 is incorporated to provide variable pre-loading of workplate 30 against elements 34, 40, 46 and 44. Elements 40 and 44 are electrically interconnected by a microprocessor or dedicated circuitry 50 which performs the transfer function 16 described in FIG. 4.

Thus a vertical disturbance F of the grinding force may be detected by elements 40 and fed forward with appropriate filtering, phase shift and amplification to element 44 which, by virtue of a change in length, effects a vertical motion of workplate 30 in such a way that the source of a periodic disturbance associated with lobing growth is anticipated and counteracted.

An important aspect of element 50 is that it must be arranged to behave adaptively in response to rate of change of the periodic force F so that the lobing growth rate is always maximum and negative. A further aspect is that the structure shown in FIG. 5 should be designed so as to avoid natural resonance frequencies close to the lobing frequency. Thus the combination of masses contained in elements 30 and the stiffness of element 48 must be such that $w << K/m$, where w is the lobing frequency, k is the spring stiffness and m is the mass.

Figure 6:
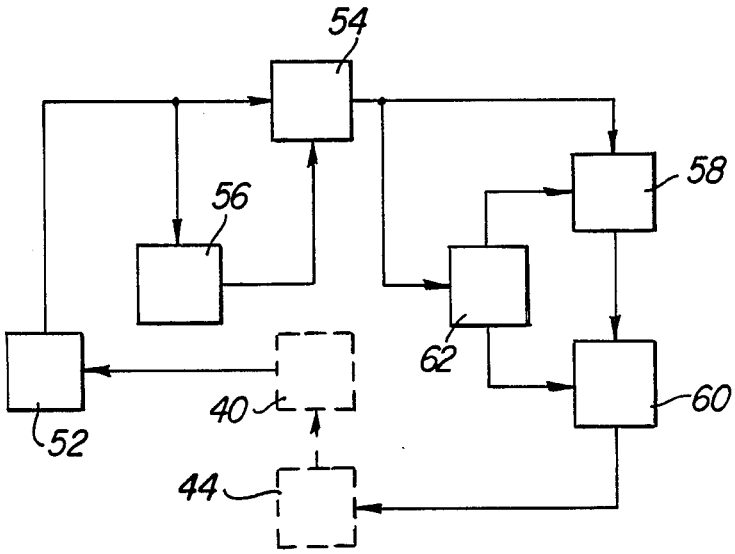
FIG. 6 shows a possible configuration of the transfer function element 16 in FIG. 4 which is contained within element 50 in FIG. 5.

In FIG. 6, grinding force signals which are sensed by element 40 are transmitted to a charge amplifier 52 which should have a high input impedance. The amplified signal is then transmitted to a notch filter element 54, the band width of which is controlled by a fast fourier transform element 56. The filtered signal, which is at the lobing frequency, is then transmitted to a phase shifting element 58 and then to a special amplifier 60 which drives the piezoelectric actuator element 44. The phase and amplitude of the filtered signal is adjusted automatically by reference to a comparator element 62 which compares the amplitudes of the signal leaving the filter element 54 on successive cycles. Element 62 is the adapted control element which makes phase and gain decisions on the basis of the sense and rate of change of the received signal in such a way that the amplitude of lobing is continuously reduced at the maximum possible rate.

It is possible that the Fourier analysis of the signal performed by element 56 will occupy a longer time period than the actual grinding process time for the component. Therefore it is the intention that data should be generated early in the production process and then used to control subsequent throughput, since each component will be ground with nominally identical geometry as defined in FIG. 1. Once the lobing frequency has been identified and the appropriate band width set for filter element 54, then element 56 is no longer required in the feed forward loops and adaptive control of elements 58 and 60 proceeds at a rate sufficient for in-process control of lobing for individual components.

We claim:

1. A centerless grinding maching for grinding a component having a generally circular periphery, the machine comprising:

(a) means for supporting the component at points on its periphery during grinding:

(b) means for detecting periodic irregularities in the periphery of the component during the grinding of the component;

(c) means for analysing the periodic irregularities in the periphery of the component detected by the detecting means, the analysing means producing a signal indicative of the adjustment in the position of the component necessary to eliminate, during grinding, the detected periodic irregularities in the periphery of the component; and (d) means for periodically adjusting the support means of the component in response to the signals from the analysing means to eliminate said periodic irregularities in the periphery of the component.

2. A grinding machine according to claim 1, wherein the detecting means includes sensors which detect the periodic irregularities in the periphery of the component.

3. A method of centerless grinding in a grinding machine a component having a generally circular periphery, which method comprises:

(i) supporting the component at points on its periphery and causing the component to rotate against the grinding surface;

(ii) detecting periodic irregularities in the periphery of the component;

(iii) analysing the periodic irregularities to determine the adjustment in the position of the component necessary to eliminate said irregularities and producing a signal indicative of the adjustment necessary; and (iv) adjusting the position of the component in response to the signal to eliminate the periodic irregularities.

4. A centerless grinding machine for grinding a component having a generally circular periphery, the machine comprising:

(a) means for supporting the component at points on the periphery during grinding;

(b) a detecting means which includes sensors for detecting periodic irregularities in the periphery of the component during the grinding of the component;

(c) an analysing means for analysing the periodic irregularities detected by the detecting means and being capable of producing a signal indicative of the adjustment in the position of the component necessary to eliminate, during grinding, the detected periodic irregularities, the analysing means including means for producing a signal indicative of the adjustment necessary; and (d) means for periodically adjusting the support means of the component in response to the signals from the analysing means to eliminate the periodic irregularities, the sensors also detecting the reaction forces exerted on the support means by the component during grinding.

5. A grinding machine according to claim 1, wherein the support means comprises:

a grinding wheel rotatable about the axis;

a regulating wheel rotatable about an axis which is generally parallel to the axis of the grinding wheel, the regulating wheel being aligned with and spaced apart from the grinding wheel to define a zone in which a component to be ground is capable of being accommodated, the circumference of the grinding wheel and circumference of the regulating wheel each providing a point of contact with the component to be ground; and a support element disposed between the grinding wheel and the regulating wheel to provide a third point of contact with the component to be ground.

6. A grinding machine according to claim 5, wherein the detecting means comprises means for sensing, during grinding, the periodic force being exerted on the support element by the component, the periodic force being indicative of the lobe frequency on the periphery of a component being ground.

7. A grinding machine according to claim 5, wherein the analysing means is capable of analysing the periodic force exerted on the support element by the component, the analysing means including a means for computing the periodic adjustment in height of the support element necessary to eliminate the lobes on the periphery of the component, the analysing means producing a signal indicative of the necessary adjustment in height of the support element required.

8. A grinding machine according to claim 7, wherein the adjusting means comprises means for adjusting the height of the support element in response to the signal from the analysing means.

* * * * *